US010374341B1

(12) United States Patent
Phillips et al.

(10) Patent No.: US 10,374,341 B1
(45) Date of Patent: Aug. 6, 2019

(54) CARD EDGE CONNECTOR HAVING A CONTACT POSITIONER

(71) Applicant: TE CONNECTIVITY CORPORATION, Berwyn, PA (US)

(72) Inventors: Michael John Phillips, Camp Hill, PA (US); Randall Robert Henry, Lebanon, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 16/045,178

(22) Filed: Jul. 25, 2018

(51) Int. Cl.

| | |
|---|---|
| ***H01R 13/64*** | (2006.01) |
| ***H01R 12/70*** | (2011.01) |
| ***H01R 12/73*** | (2011.01) |
| ***H01R 12/72*** | (2011.01) |

(52) U.S. Cl.
CPC ..... *H01R 12/7005* (2013.01); *H01R 12/721* (2013.01); *H01R 12/73* (2013.01)

(58) Field of Classification Search
CPC ..... H01R 29/00; H01R 43/00; H01R 27/00; H01R 13/659; H01R 12/7005; H01R 12/721
USPC ..... 439/377
See application file for complete search history.

(56) References Cited

U.S. PATENT DOCUMENTS

| | | | | |
|---|---|---|---|---|
| 6,565,387 | B2 | 5/2003 | Cohen | |
| 8,162,675 | B2 | 4/2012 | Regnier et al. | |
| 8,226,441 | B2 | 7/2012 | Regnier et al. | |
| 8,465,302 | B2 | 6/2013 | Regnier et al. | |
| 8,753,145 | B2 | 6/2014 | Lang et al. | |
| 9,391,407 | B1 * | 7/2016 | Bucher | H01R 13/659 |
| 9,450,360 | B2 * | 9/2016 | Zhu | H01R 27/00 |
| 2006/0189180 | A1 * | 8/2006 | Lang | H01R 43/00 439/76.1 |
| 2011/0300757 | A1 * | 12/2011 | Regnier | H01R 29/00 439/626 |

* cited by examiner

*Primary Examiner* — Jean F Duverne

(57) ABSTRACT

A card edge connector includes a housing and a contact assembly. The housing has a cavity, a card slot and a chamber adjacent the card slot. The card slot receives a card edge of a module circuit board of a pluggable module. The contact assembly has a contact holder, first contacts held by the contact holder, and a contact positioner. The contact positioner is forward of the contact holder and located in the chamber for receiving mating ends of the first contacts. The contact positioner is movable in the chamber relative to the contact holder and the housing between an inward position and an outward position. The contact positioner moves the mating ends of the first contacts outward from the card slot as the contact positioner is moved from the inward position to the outward position.

20 Claims, 6 Drawing Sheets

CARD EDGE CONNECTOR HAVING A CONTACT POSITIONER

BACKGROUND OF THE INVENTION

The subject matter herein relates generally to card edge connectors of communication systems.

Some communication systems utilize communication connectors, such as card edge connectors to interconnect various components of the system for data communication. Some known communication systems use pluggable modules, such as I/O modules, that are electrically connected to the card edge connectors. The pluggable modules have module circuit boards having card edges that are mated with the card edge connectors during the mating operation. Each card edge connector has an upper row of contacts and a lower row of contact for mating with the corresponding circuit board. The contacts are typically curved at the mating ends to provide a large lead-in for the circuit board during mating to prevent mechanical stubbing and damage to the contacts during mating. However, such extra lengths of contacts at the ends of the contacts beyond the mating interfaces of the contacts create electrical stubs that affect the electrical performance of the card edge connectors.

A need remains for a card edge connector having an improved mating interface greatly reducing electrical stubs of the contacts of the card edge connector.

BRIEF DESCRIPTION OF THE INVENTION

In one embodiment, a card edge connector is provided for mating with a pluggable module including a housing and a contact assembly. The housing has a cavity, a card slot at a front of the housing and a chamber adjacent the card slot. The card slot is configured to receive a card edge of a module circuit board of the pluggable module. The contact assembly is received in the cavity and has a contact holder, first contacts arranged in a first contact array held by the contact holder, and a contact positioner. The first contacts have mating ends extending from the contact holder into the card slot for mating with the module circuit board. The contact positioner is forward of the contact holder and located in the chamber for receiving the mating ends of the first contacts. The contact positioner is movable in the chamber relative to the contact holder and the housing between an inward position and an outward position. The contact positioner moves the mating ends of the first contacts outward from the card slot as the contact positioner is moved from the inward position to the outward position.

In another embodiment, a card edge connector is provided for mating with a pluggable module including a housing extending between a front and a rear and having a cavity between the front and the rear. The housing has a card slot at the front configured to receive a card edge of a module circuit board of the pluggable module. The housing has a top wall above the card slot including an upper chamber and a bottom wall below the card slot including a lower chamber. The card edge connector includes a contact assembly received in the cavity. The contact assembly has a contact holder, upper contacts arranged in an upper contact array held by the contact holder and lower contacts arranged in a lower contact array held by the contact holder, and an upper contact positioner associated with the upper contacts and a lower contact positioner associated with the lower contacts. The upper contacts have mating ends extending from the contact holder into the card slot for mating with the module circuit board and the lower contacts have mating ends extending from the contact holder into the card slot for mating with the module circuit board. The upper contact positioner is located in the upper chamber forward of the contact holder receiving the mating ends of the upper contacts and the lower contact positioner is located in the lower chamber forward of the contact holder receiving the mating ends of the lower contacts. The upper contact positioner and the lower contact positioner are located on opposite sides of the card slot. The upper contact positioner and the lower contact positioner are movable in the housing relative to the contact holder generally toward each other and away from each other between inward positions and outward positions. The upper contact positioner moves the mating ends of the upper contacts outward from the card slot as the contact positioner is moved from the inward position to the outward position. The lower contact positioner moves the mating ends of the lower contacts outward from the card slot as the contact positioner is moved from the inward position to the outward position.

In a further embodiment, a receptacle connector assembly is provided including a receptacle cage having walls defining a module channel configured to receive a pluggable module and providing electrical shielding for the module channel. The receptacle connector assembly includes a card edge connector within the module channel for mating with the pluggable module. The card edge connector includes a housing and a contact assembly. The housing has a cavity, a card slot at a front of the housing and a chamber adjacent the card slot. The card slot is configured to receive a card edge of a module circuit board of the pluggable module. The contact assembly is received in the cavity and has a contact holder, first contacts arranged in a first contact array held by the contact holder, and a contact positioner. The first contacts have mating ends extending from the contact holder into the card slot for mating with the module circuit board. The contact positioner is forward of the contact holder and located in the chamber for receiving the mating ends of the first contacts. The contact positioner is movable in the chamber relative to the contact holder and the housing between an inward position and an outward position. The contact positioner moves the mating ends of the first contacts outward from the card slot as the contact positioner is moved from the inward position to the outward position.

DETAILED DESCRIPTION OF THE INVENTION

Figure 1:
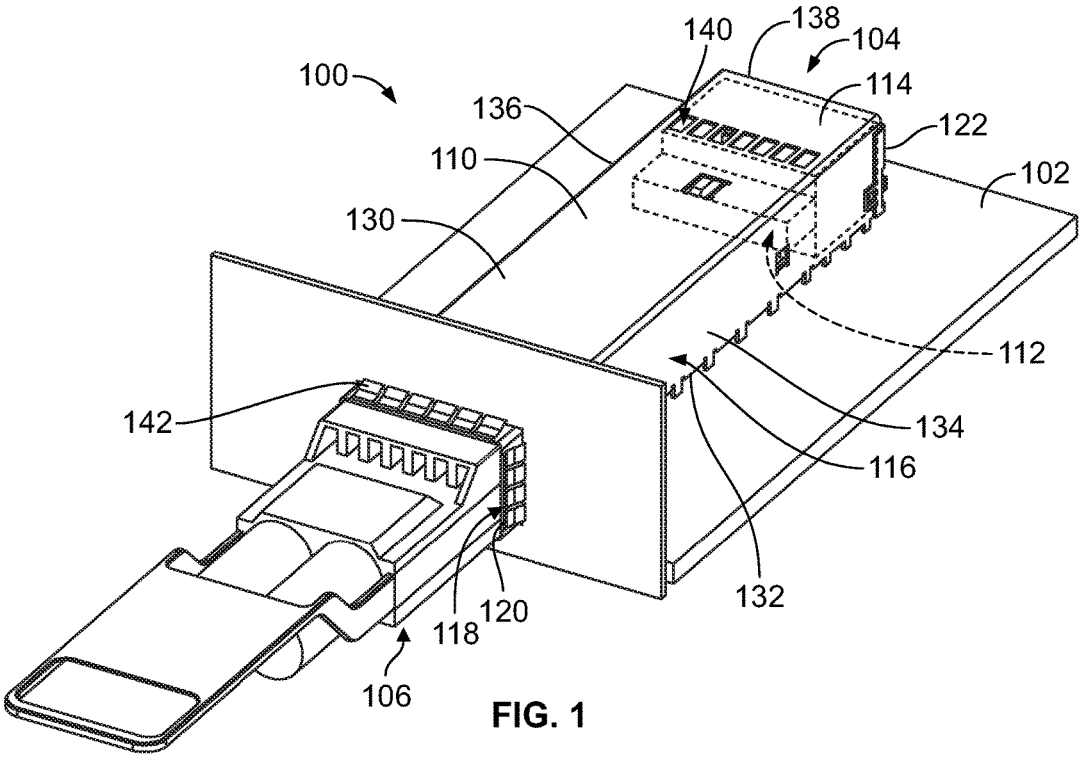
FIG. 1 is a front perspective view of a communication system formed in accordance with an exemplary embodiment.

FIG. 1 is a front perspective view of a communication system 100 formed in accordance with an exemplary embodiment. The communication system includes a host circuit board 102 and a receptacle connector assembly 104 mounted to the host circuit board 102. A pluggable module 106 (fully shown in FIG. 2) is configured to be electrically connected to the receptacle connector assembly 104. The pluggable module 106 is electrically connected to the host circuit board 102 through the receptacle connector assembly 104.

In an exemplary embodiment, the receptacle connector assembly 104 includes a receptacle cage 110 and a card edge connector 112 (shown with phantom lines) adjacent the receptacle cage 110. For example, in the illustrated embodiment, the card edge connector 112 is received in the receptacle cage 110. In other various embodiments, the card edge connector 112 may be located rearward of the receptacle cage 110. In various embodiments, the receptacle cage 110 is enclosed and provides electrical shielding for the card edge connector 112. The pluggable modules 106 are loaded into the receptacle cage 110 and are at least partially surrounded by the receptacle cage 110. In an exemplary embodiment, the receptacle cage 110 is a shielding, stamped and formed cage member that includes a plurality of shielding walls 114 that define one or more module channels for receipt of corresponding pluggable modules 106. In other embodiments, the receptacle cage 110 may be open between frame members to provide cooling airflow for the pluggable modules 106 with the frame members of the receptacle cage 110 defining guide tracks for guiding loading of the pluggable modules 106 into the receptacle cage 110. In other various embodiments, the receptacle connector assembly 104 may be provided without the receptacle cage 110, rather only including the card edge connector 112.

In the illustrated embodiment, the receptacle cage 110 is a single port receptacle cage configured to receive a single pluggable module 106. In other various embodiments, the receptacle cage 110 may be a ganged cage member having a plurality of ports ganged together in a single row and/or a stacked cage member having multiple ports stacked as an upper port and a lower port. The receptacle cage 110 includes a module channel 116 having a module port 118 open to the module channel 116. The module channel 116 receives the pluggable module 106 through the module port 118. In an exemplary embodiment, the receptacle cage 110 extends between a front end 120 and a rear end 122. The module port 118 is provided at the front end 120. Any number of module channels 116 may be provided in various embodiments arranged in a single column or in multiple columns (for example, 2X2, 3X2, 4X2, 4X3, 4X1, 2X1, and the like). Optionally, multiple card edge connectors 112 may be arranged within the receptacle cage 110, such as when multiple rows and/or columns of module channels 116 are provided.

In an exemplary embodiment, the walls 114 of the receptacle cage 110 include a top wall 130, a bottom wall 132, a first side wall 134 and a second side wall 136 extending from the top wall 130. The bottom wall 132 may rest on the host circuit board 102. In other various embodiments, the receptacle cage 110 may be provided without the bottom wall 132. Optionally, the walls 114 of the receptacle cage 110 may include a rear wall 138 at the rear end 122. The walls 114 define a cavity 140. For example, the cavity 140 may be defined by the top wall 130, the bottom wall 132, the side walls 134, 136 and the rear wall 138. The cavity 140 includes the module channel 116. In various embodiments, the cavity 140 receives the card edge connector 112, such as at the rear end 122. Other walls 114 may separate or divide the cavity 140 into additional module channels 116, such as in embodiments using ganged and/or stacked receptacle cages. For example, the walls 114 may include one or more vertical divider walls between ganged module channels 116. In various embodiments, the walls 114 may include a separator panel between stacked upper and lower module channels 116. The separator panel may include an upper panel and a lower panel that form a space between the upper and lower module channels 116, such as for airflow, for a heat sink, for routing light pipes, or for other purposes.

In an exemplary embodiment, the receptacle cage 110 may include one or more gaskets 142 at the front end 120 for providing electrical shielding for the module channels 116. For example, the gaskets 142 may be provided at the port 118 to electrically connect with the pluggable modules 106 received in the module channel 116. Optionally, the pluggable module 106 may include a gasket that engages the receptacle cage 110 rather than the receptacle cage 110 having a gasket that engages the pluggable module 106. In an exemplary embodiment, the gaskets 142 may be provided around the exterior of the receptacle cage 110 for interfacing with a panel (not shown), such as when the front end 120 of the receptacle cage 110 extends through a cutout in the panel. The gaskets 142 may include spring fingers or other deflectable features that are configured to be spring biased against the panel to create an electrical connection with the panel.

Optionally, the receptacle connector assembly 104 may include one or more heat sinks (not shown) for dissipating heat from the pluggable modules 106. For example, the heat sink may be coupled to the top wall 130 for engaging the pluggable module 106 received in the module channel 116. The heat sink may extend through an opening in the top wall 130 to directly engage the pluggable module 106. Other types of heat sinks may be provided in alternative embodiments.

In an exemplary embodiment, the card edge connector 112 is received in the cavity 140, such as proximate to the rear wall 138. However, in alternative embodiments, the card edge connector 112 may be located behind the rear wall 138 exterior of the receptacle cage 110 and extend into the cavity 140 to interface with the pluggable module(s) 106. In an exemplary embodiment, a single card edge connector 112 is provided. In alternative embodiments, the communication system 100 may include multiple card edge connectors 112 (for example, for stacked and/or ganged receptacle cages) for mating with corresponding pluggable modules 106.

In an exemplary embodiment, the pluggable modules 106 are loaded through the port 118 at the front end 120 to mate with the card edge connector 112. The shielding walls 114 of the receptacle cage 110 provide electrical shielding around the card edge connector 112 and the pluggable module 106, such as around the mating interface between the card edge connector 112 and the pluggable module 106.

Figure 2:
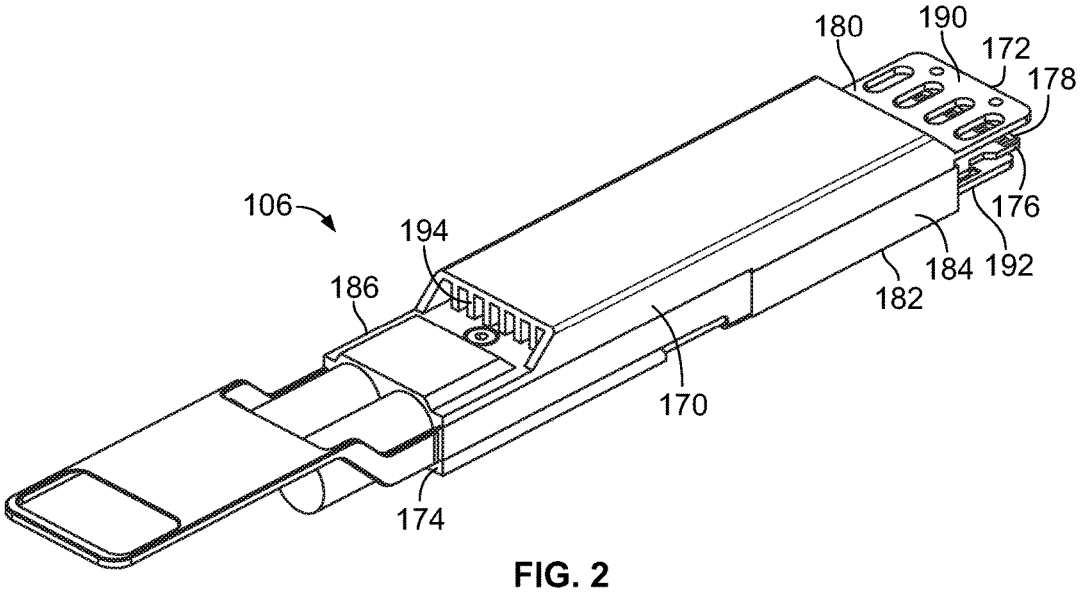
FIG. 2 is a front perspective view of a pluggable module of the communication system in accordance with an exemplary embodiment.
Figure 3:
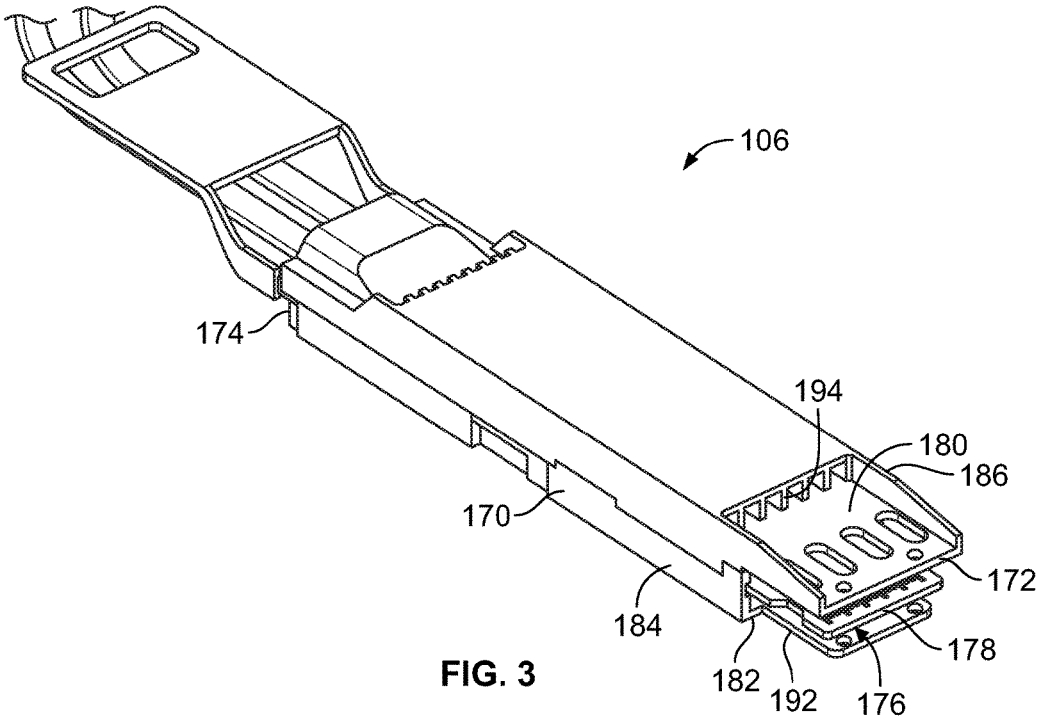
FIG. 3 is a rear perspective view of the pluggable module in accordance with an exemplary embodiment.

FIG. 2 is a front perspective view of the pluggable module 106 in accordance with an exemplary embodiment. FIG. 3 is a rear perspective view of the pluggable module 106 in accordance with an exemplary embodiment. The pluggable module 106 has a pluggable body 170, which may be defined by one or more shells. The pluggable body 170 may be thermally conductive and/or may be electrically conductive, such as to provide EMI shielding for the pluggable module 106. The pluggable body 170 includes a mating end 172 and an opposite front end 174. The mating end 172 is configured to be inserted into the corresponding module channel 116 (shown in FIG. 1). The front end 174 may be a cable end having a cable extending therefrom to another component within the system.

The pluggable module 106 includes a module circuit board 176 that is configured to be communicatively coupled to the card edge connector 112 (shown in FIG. 1). The module circuit board 176 may be accessible at the mating end 172. The module circuit board 176 has a card edge 178 extending between a first or upper surface and a second or lower surface at a mating end of the module circuit board 176. The module circuit board 176 includes mating contacts, such as pads or circuits, at the card edge 178 configured to be mated with the card edge connector 112. The module circuit board 176 may include components, circuits and the like used for operating and or using the pluggable module 106. For example, the module circuit board 176 may have conductors, traces, pads, electronics, sensors, controllers, switches, inputs, outputs, and the like associated with the module circuit board 176, which may be mounted to the module circuit board 176, to form various circuits.

The pluggable module 106 includes an outer perimeter defining an exterior of the pluggable body 170. For example, the outer perimeter may be defined by a top 180, a bottom 182, a first side 184 and a second side 186. The pluggable body 170 may have other shapes in alternative embodiments. In an exemplary embodiment, the pluggable module 106 includes a module top wall 190 at the mating end 172 above the module circuit board 176 and a module bottom wall 192 at the mating end 172 below the module circuit board 176. The module top wall 190 and the module bottom wall 192 shroud the module circuit board 176 and protect the module circuit board 176 during mating. In an exemplary embodiment, the module top wall 190 and the module bottom wall 192 are used to actuate the contacts of the card edge connector 112 into mating engagement with the module circuit board 176 as the pluggable module 106 is mated with the card edge connector 112, as described in further detail below. As such, the mating action of the pluggable module 106 with the card edge connector 112 is used to activate the mating action and electrical connection between the card edge connector 112 and the module circuit board 176. The contacts of the card edge connector 112 may be held open in released positions and clamped closed on to the module circuit board 176 when positioned in the card edge connector 112 when there is no risk of stubbing such contacts. As such, the contacts of the card edge connector 112 may be made electrically shorter, eliminating electrical stub at the ends of the contacts of the card edge connector 112 enhancing electrical performance through the communication system 100.

In an exemplary embodiment, the pluggable body 170 provides heat transfer for the module circuit board 176, such as for the electronic components on the module circuit board 176. For example, the module circuit board 176 is in thermal communication with the pluggable body 170 and the pluggable body 170 transfers heat from the module circuit board 176. Optionally, the pluggable body 170 may include a plurality of heat transfer fins 194 along at least a portion of the outer perimeter, such as the top 180, of the pluggable module 106 for dissipating heat from the pluggable body 170.

Figure 4:
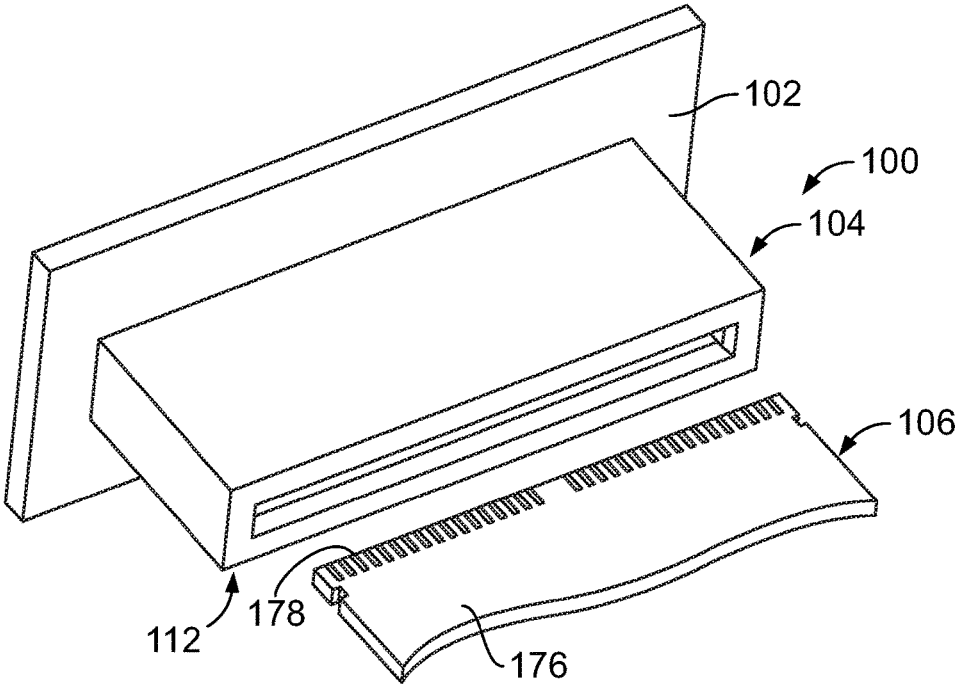
FIG. 4 is a front perspective view of the communication system in accordance with an exemplary embodiment.

FIG. 4 is a front perspective view of the communication system 100 in accordance with an exemplary embodiment. The receptacle connector assembly 104 is shown as a card edge connector 112 mounted to the circuit board 102 (without a receptacle cage). The card edge connector 112 may be mounted horizontally or vertically in various embodiments. The card edge connector 112 may be mounted to the circuit board 102 to receive the pluggable module in a direction perpendicular to the circuit board 102 in various embodiments. In alternative embodiments, the card edge connector 112 may be a right angle card edge connector mounted to the circuit board 102 to receive the pluggable module 106 in a direction parallel to the circuit board 102. In the illustrated embodiment, the receptacle connector assembly 104 is a pass-through connector having the mating end and the mounting end of the housing parallel to each other rather than perpendicular to each other such that the contacts pass straight through the housing rather than being right angle contacts.

In the illustrated embodiment, the pluggable module 106 includes the module circuit board 176 without the outer pluggable body holding the module circuit board 176. The module circuit board 176 includes the card edge 178 between a first or upper surface and a second or lower surface at a mating end of the module circuit board 176. The module circuit board 176 includes the contact pads at the card edge 178, such as at both the upper surface and the lower surface, configured to be mated with the contacts of the card edge connector 112.

Figure 5:
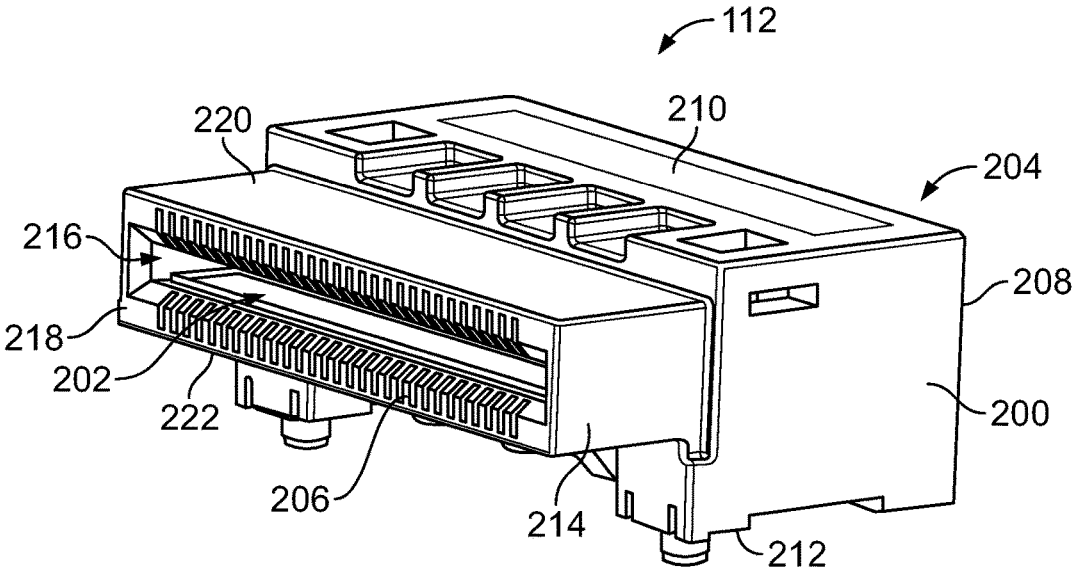
FIG. 5 is an exploded view of a card edge connector of the communication system in accordance with an exemplary embodiment.

FIG. 5 is an exploded view of the card edge connector 112 in accordance with an exemplary embodiment. The card edge connector 112 includes a housing 200 having a contact assembly 202 received in a cavity 204 of the housing 200. The housing 200 extends between a front 206 and a rear 208. The housing 200 extends between a top 210 and a bottom 212. In the illustrated embodiment, the bottom 212 defines a mounting end configured to be mounted to the host circuit board 102 and the front 206 defines the mating end configured to be mated with the pluggable module 106. Other orientations are possible in alternative embodiments.

The housing 200 includes a top wall 220 at the top 210 and bottom wall 222 and the bottom 212. In the illustrated embodiment, the housing 200 includes a shroud 214 at the front 206 configured to be mated with the pluggable module 106. The shroud 214 includes a front face 218. The shroud 214 is configured to be received in the pluggable module 106. The housing 200 includes a card slot 216 at the front 206. For example, the card slot 216 may be located in the shroud 214 and open at the front face 218. The card slot 216 receives the card edge 178 (shown in FIG. 3) of the module circuit board 176 (shown in FIG. 3).

Figure 6:
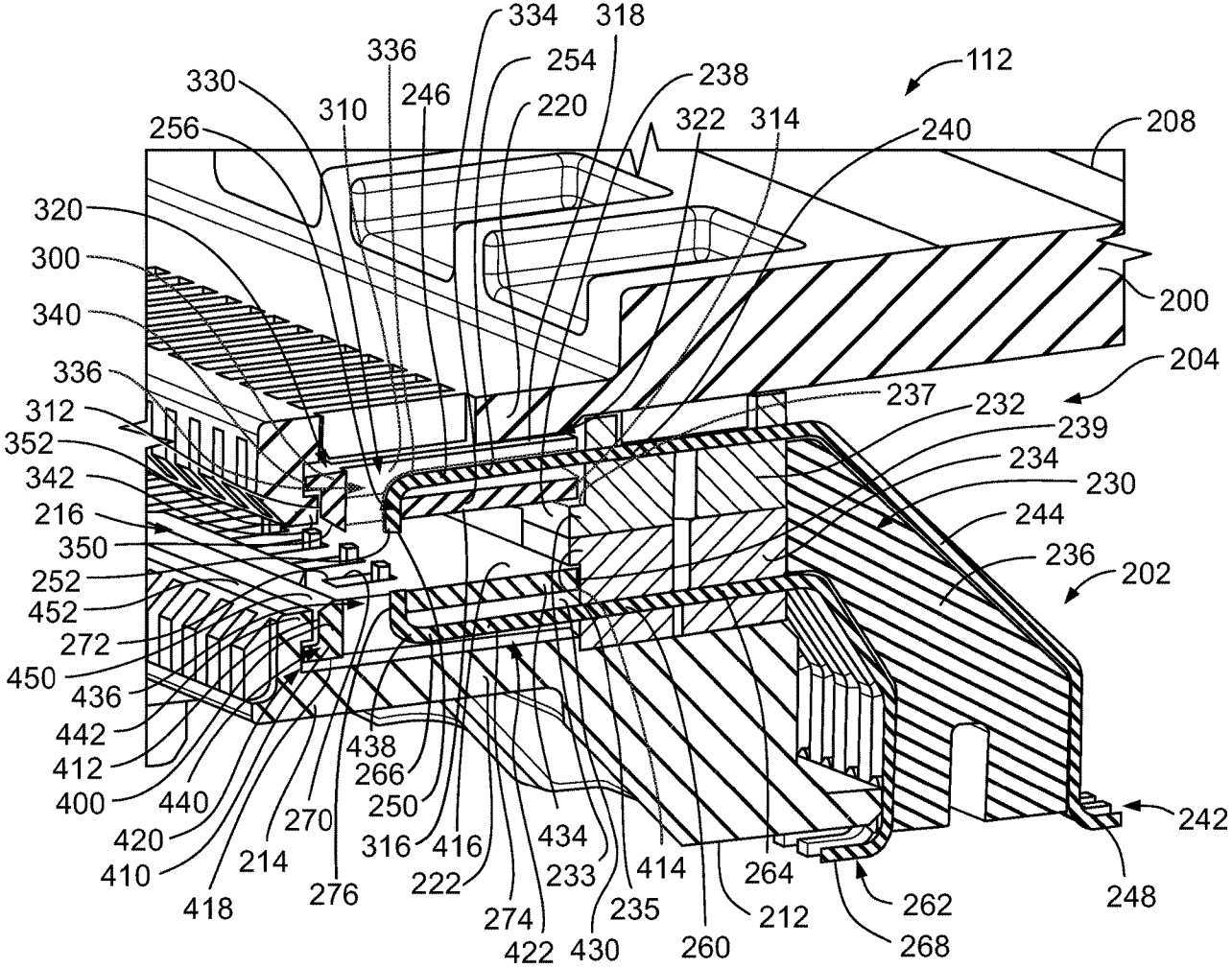
FIG. 6 is a partial sectional view of the card edge connector in accordance with an exemplary embodiment.

FIG. 6 is a partial sectional view of the card edge connector 112 in accordance with an exemplary embodiment. The contact assembly 202 includes a contact holder 230, upper contacts 240 arranged in an upper contact array 242, lower contacts 260 arranged in a lower contact array 262, an upper contact positioner 300 for the upper contacts 240, and a lower contact positioner 400 for the lower contacts 260. In an exemplary embodiment, the upper and lower contacts 240, 260 are held in at least one contact holder 230. For example, the contact holder 230 may be a dielectric body holding one or more upper contact 240 and/or one or more lower contact 260. The contact holder 230 is separate from the housing 200 and loaded into the housing 200, such as through the rear 208 and/or the bottom 212.

In various embodiments, the contact holder 230 may be overmolded over one or more upper contact 240 and/or one or more lower contact 260. In various embodiments, the upper contacts 240 of the upper contact array 242 may be overmolded by an upper contact holder and the lower contacts 260 of the lower contact array 262 may be overmolded by a lower contact holder separate and discrete from the upper contact holder that are separately loaded into the cavity 204 of the housing 200. In other various embodiments, the upper contacts 240 may be paired with corresponding lower contacts 260 in corresponding wafers and overmolded by a corresponding wafer body defining the corresponding contact holder 230. The dielectric wafers may be stacked together in a wafer stack and loaded into the cavity 204, such as through the rear 208 or the bottom 212 of the housing 200.

Each upper contact 240 includes a transition portion 244 extending between a mating end 246 and a terminating end 248. The transition portion 244 is held by the contact holder 230. The terminating end 248 is configured to be terminated to the host circuit board 102. The mating end 246 is configured to extend into the shroud 214 for mating with the module circuit board 176. In an exemplary embodiment, the upper contacts 240 are flexible and configured to be elastically deformed and flexed during use, such as during mating with the module circuit board 176. For example, the mating ends 246 are defined by cantilevered spring beams extending forward from the contact holder 230. In an exemplary embodiment, the mating end 246 includes a mating interface 250 at a tip 252 of the upper contact 240. For example, the spring beam defining the mating end 246 includes an arm 254 and a finger 256 extending from the arm 254 to the tip 252. The arm 254 extends generally forwardly (for example, horizontally) and the finger 256 extends generally inward (for example, vertically) from the arm 254. The upper contact 240 ends at the mating interface 250 and does not create an electrical stub beyond the mating interface 250. The upper contact 240 terminates at the mating interface 250 at the tip 252. The upper contact 240 does not include a flared lead-in beyond the mating interface 250 as is common with conventional contacts.

Each lower contact 260 includes a transition portion 264 extending between a mating end 266 and a terminating end 268. The transition portion 264 is held by the contact holder 230. The terminating end 268 is configured to be terminated to the host circuit board 102. The mating end 266 is configured to extend into the shroud 214 for mating with the module circuit board 176. In an exemplary embodiment, the lower contacts 260 are flexible and configured to be elastically deformed and flexed during use, such as during mating with the module circuit board 176. For example, the mating ends 266 are defined by cantilevered spring beams extending forward from the contact holder 230. In an exemplary embodiment, the mating end 266 includes a mating interface 270 at a tip 272 of the lower contact 260. For example, the spring beam defining the mating end 266 includes an arm 274 and a finger 276 extending from the arm 274 to the tip 272. The arm 274 extends generally forwardly (for example, horizontally) and the finger 276 extends generally inward (for example, vertically) from the arm 274. The lower contact 260 ends at the mating interface 270 and does not create an electrical stub beyond the mating interface 270. The lower contact 260 terminates at the mating interface 270 at the tip 272. The lower contact 260 does not include a flared lead-in beyond the mating interface 270 as is common with conventional contacts.

In an exemplary embodiment, the contact holder 230 includes an upper holder member 232, a lower holder member 234, and a contact organizer 236 at a rear of the contact holder 230. In various embodiments, the upper holder member 232 and/or the lower holder member 234 are separate and discrete pieces from the contact organizer 236. For example, the upper holder member 232, the lower holder member 234 and the contact organizer 236 may be separately molded pieces. In an exemplary embodiment, the upper holder member 232 is overmolded around the transition portions 244 of the upper contacts 240 and the lower holder member 234 is overmolded around the transition portions 264 of the lower contacts 260. The contact organizer 236 is positioned rearward of the upper holder member 232 and the lower holder member 234 to support the transition portions 244, 264 and position the terminating ends 248, 268 for termination to the host circuit board 102. In the illustrated embodiment, the contact organizer 236 forms a right angle to transition the transition portions 244, 264 from the mating ends 246, 266 to the bottom 212 of the housing 200. Other orientations are possible in alternative embodiments. In other various embodiments, the organizer 236 may include an upper organizer member and a lower organizer member separate and discrete from the upper organizer member. In other various embodiments, the organizer 236 may be an integral part of the upper holder member 232 and/or the lower holder member 234.

In an exemplary embodiment, the contact holder 230 includes a front 238. The upper holder member 232 includes one or more support tabs 233 at the front 238. The lower holder member 234 includes one or more support tabs 235 at the front 238. The upper support tabs 233 are used to support the upper contact positioner 300. For example, the upper support tabs 233 include an upper surface 237 that supports and/or positions the upper contact positioner 300 from below. The upper contact positioner 300 is located forward of the front 238 above the upper support tabs 233. The upper contact positioner 300 is movable relative to the contact holder 230 at the front 238. The lower support tabs 235 are used to support the lower contact positioner 400. For example, the lower support tabs 235 include a lower surface 239 that supports and/or positions the lower contact positioner 400 from above. The lower contact positioner 400 is located forward of the front 238 below the lower support tabs 235. The lower contact positioner 400 is movable relative to the contact holder 230 at the front 238.

The upper contact positioner 300 includes a body 310 extending between a front 312 and a rear 314. The upper contact positioner 300 includes an inner end 316 (for example, bottom) and an outer end 318 (for example, top). The inner end 316 faces the card slot 216. The outer end 318 faces the top wall 220. In an exemplary embodiment, the top wall 220 includes an upper chamber 320 adjacent the card slot 216. The upper contact positioner 300 is received in the upper chamber 320. In an exemplary embodiment, the upper contact positioner 300 is movable within the upper chamber 320 relative to the contact holder 230 and the housing 200 between an inward position and an outward position. The upper contact positioner 300 moves the mating ends 246 of the upper contacts 240 as the upper contact positioner 300 is moved within the upper chamber 320. For example, the upper contact positioner 300 lifts the mating ends 246 outward from the card slot 216 (for example, upward) as the upper contact positioner 300 is moved from the inward position to the outward position. The upper contact positioner 300 lifts the mating ends 246 outward to reduce the risk of mechanical stubbing with the module circuit board 176 when the module circuit board 176 is received in the card slot 216.

In an exemplary embodiment, a gap 322 is defined within the upper chamber 320 above the outer end 318 of the upper contact positioner 300 and the inner surface of the top wall 220. The width of the gap 322 changes as the upper contact positioner 300 is moved between the inward position and the outward position. The gap 322 is largest when the upper contact positioner 300 is in the inward position. The gap 322 is smallest when the upper contact positioner 300 is in the outward position. Optionally, the gap 322 may have a zero or near-zero width when the upper contact positioner 300 is in the outward position. For example, the outer end 318 may abut the inner surface of the top wall 220 in the outward position.

In an exemplary embodiment, the upper contact positioner 300 includes contact channels 330 receiving the mating ends 246 of the upper contacts 240. The contact channels 330 are defined by sidewalls and end walls 334. In the illustrated embodiment, the end wall 334 is located below the mating end 246 of the upper contact 240 along the inner end 316 of the upper contact positioner 300. Optionally, the contact channels 330 may be open along the outer end 318. Alternatively, another end wall 334 may be provided along the outer end 318 above the mating ends 246 of the upper contacts 240.

The upper contact positioner 300 includes contacts slots 336 at the inner end 316 open to the contact channels 330. The contacts slots 336 receive portions of the upper contacts 240. For example, the arm 254 may extend through the contact channel 330 and the finger 256 may extend into the contact slot 336. The tip 252 is exposed inward of the inner end 316 through the contact slot 336. For example, the finger 256 may extend through the contact slot 336 inward of the inner end 316 such that the tip 252 is located inward of the inner end 316 and is exposed in the card slot 216 for mating with the module circuit board 176.

In an exemplary embodiment, the upper contact positioner 300 includes edges 338 (also shown in FIG. 8) between the contact channels 330 and the contacts slots 336. For example, the edges 338 are defined at the corner between the contact channels 330 and the contacts slots 336. In an exemplary embodiment, the edges 338 are used to position the mating ends 246 of the upper contacts 240. For example, the arm 254 and/or the finger 256 may be supported at the edge 338. In an exemplary embodiment, the mating ends 246 are preloaded in the upper contact positioner 300. For example, the mating ends 246 are flexed or deflected when received in the upper contact positioner 300 such that the mating ends 246 are spring biased against the upper contact positioner 300 to press downward on the upper contact positioner 300. Optionally, the mating end 246 may press downward at the edge 338. The mating end 246 biases the upper contact positioner 300 to the inward position. The upper contact positioner 300 may be pushed outward by the module circuit board 176 when the module circuit board 176 is loaded into the card slot 216. The upper contact positioner 300 pushes the mating ends 246 of the upper contacts 240 outward as the upper contact positioner 300 is moved by the module circuit board 176 toward the outward position.

The upper contact positioner 300 includes a lip 340 (also shown in FIG. 7) at the front 312. The lip 340 is configured to engage an upper support land 342 of the housing 200 in the upper chamber 320. The upper support land 342 is used to support the upper contact positioner 300. For example, the upper support land 342 includes an upper surface 344 that supports and/or positions the upper contact positioner 300 from below. The lip 340 is located above the upper support land 342 and supported by the upper support land 342. The end wall 334 is supported by the upper support tabs 233 at the rear 314. The upper contact positioner 300 is movable relative to the upper support land 342 and the upper support tabs 233.

In an exemplary embodiment, the upper contact positioner 300 includes a lead-in edge 350 at the front 312. The lead-in edge 350 is provided at the inner end 316. In the inward position, the lead-in edge 350 is located inward of an upper wall 352 defining the card slot 216. As such, the lead-in edge 350 is positioned to engage the module circuit board 176 when the module circuit board 176 is loaded into the card slot 216. The angled orientation of the lead-in edge 350 causes the module circuit board 176 to drive the upper contact positioner 300 outward (for example, upward) when the module circuit board 176 is loaded into the card slot 216.

In an exemplary embodiment, the lower contact positioner 400 is similar to the upper contact positioner 300 having a reverse orientation within the housing 200. However, the lower contact positioner 400 may include different features than the upper contact positioner 300 in various embodiments.

The lower contact positioner 400 includes a body 410 extending between a front 412 and a rear 414. The lower contact positioner 400 includes an inner end 416 (for example, top) and an outer end 418 (for example, bottom). The inner end 416 faces the card slot 216. The outer end 418 faces the bottom wall 222. In an exemplary embodiment, the bottom wall 222 includes a lower chamber 420 adjacent the card slot 216. The lower contact positioner 400 is received in the lower chamber 420. In an exemplary embodiment, the lower contact positioner 400 is movable within the lower chamber 420 relative to the contact holder 230 and the housing 200 between an inward position and an outward position. The lower contact positioner 400 moves the mating ends 266 of the lower contacts 260 as the lower contact positioner 400 is moved within the lower chamber 420. For example, the lower contact positioner 400 lifts the mating ends 266 outward from the card slot 216 (for example, downward) as the lower contact positioner 400 is moved from the inward position to the outward position. The lower contact positioner 400 lifts the mating ends 266 outward to reduce the risk of mechanical stubbing with the module circuit board 176 when the module circuit board 176 is received in the card slot 216.

In an exemplary embodiment, a gap 422 is defined within the lower chamber 420 below the outer end 418 of the lower contact positioner 400 and the inner surface of the bottom wall 222. The width of the gap 422 changes as the lower contact positioner 400 is moved between the inward position and the outward position. The gap 422 is largest when the lower contact positioner 400 is in the inward position. The gap 422 is smallest when the lower contact positioner 400 is in the outward position. Optionally, the gap 422 may have a zero or near-zero width when the lower contact positioner 400 is in the outward position. For example, the outer end 418 may abut the inner surface of the bottom wall 222 in the outward position.

In an exemplary embodiment, the lower contact positioner 400 includes contact channels 430 receiving the mating ends 266 of the lower contacts 260. The contact channels 430 are defined by sidewalls and end walls 434. In the illustrated embodiment, the end wall 434 is located below the mating end 266 of the lower contact 260 along the inner end 416 of the lower contact positioner 400. Optionally, the contact channels 430 may be open along the outer end 418. Alternatively, another end wall 434 may be provided along the outer end 418 below the mating ends 266 of the lower contacts 260.

The lower contact positioner 400 includes contacts slots 436 at the inner end 416 open to the contact channels 430. The contacts slots 436 receive portions of the lower contacts 260. For example, the arm 274 may extend through the contact channel 430 and the finger 276 may extend into the contact slot 436. The tip 272 is exposed inward of the inner end 416 through the contact slot 436. For example, the finger 276 may extend through the contact slot 436 inward of the inner end 416 such that the tip 272 is located inward of the inner end 416 and is exposed in the card slot 216 for mating with the module circuit board 176.

In an exemplary embodiment, the lower contact positioner 400 includes edges 438 between the contact channels 430 and the contacts slots 436. For example, the edges 438 are defined at the corner between the contact channels 430 and the contacts slots 436. In an exemplary embodiment, the edges 438 are used to position the mating ends 266 of the lower contacts 260. For example, the arm 274 and/or the finger 276 may be supported at the edge 438. In an exemplary embodiment, the mating ends 266 are preloaded in the lower contact positioner 400. For example, the mating ends 266 are flexed or deflected when received in the lower contact positioner 400 such that the mating ends 266 are spring biased against the lower contact positioner 400 to press upward on the lower contact positioner 400. Optionally, the mating end 266 may press upward at the edge 438. The mating end 266 biases the lower contact positioner 400 to the inward position. The lower contact positioner 400 may be pushed outward by the module circuit board 176 when the module circuit board 176 is loaded into the card slot 216. The lower contact positioner 400 pushes the mating ends 266 of the lower contacts 260 outward as the lower contact positioner 400 is moved by the module circuit board 176 toward the outward position.

The lower contact positioner 400 includes a lip 440 at the front 412. The lip 440 is configured to engage a lower support land 442 of the housing 200 in the lower chamber 420. The lower support land 442 is used to support the lower contact positioner 400. For example, the lower support land 442 includes a lower surface 444 that supports and/or positions the lower contact positioner 400 from above. The lip 440 is located below the lower support land 442 and supported by the lower support land 442. The end wall 434 is supported by the lower support tabs 235 at the rear 414. The lower contact positioner 400 is movable relative to the lower support land 442 and the lower support tabs 235.

In an exemplary embodiment, the lower contact positioner 400 includes a lead-in edge 450 at the front 412. The lead-in edge 450 is provided at the inner end 416. In the inward position, the lead-in edge 450 is located inward of a lower wall 452 defining the card slot 216. As such, the lead-in edge 450 is positioned to engage the module circuit board 176 when the module circuit board 176 is loaded into the card slot 216. The angled orientation of the lead-in edge 450 causes the module circuit board 176 to drive the lower contact positioner 400 outward (for example, downward) when the module circuit board 176 is loaded into the card slot 216.

Figure 7:
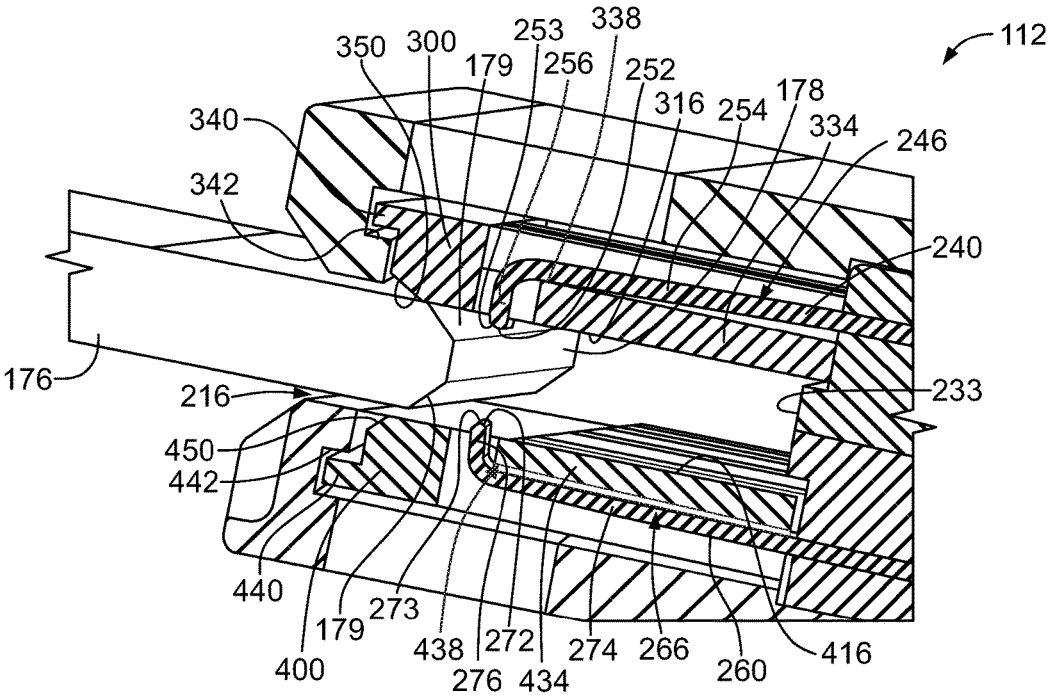
FIG. 7 is a partial sectional view of a portion of the card edge connector in accordance with an exemplary embodiment.

FIG. 7 is a partial sectional view of a portion of the card edge connector 112 in accordance with an exemplary embodiment showing the module circuit board 176 partially loaded into the card slot 216. When the card edge 178 of the module circuit board 176 is loaded into the card slot 216, the module circuit board 176 engages the contact positioners 300, 400 and forces the contact positioners 300, 400 to move outward from the inward position to the outward position. In an exemplary embodiment, the card edge 178 includes chamfered lead-in surfaces 179 at the upper surface and the lower surface. The lead-in surfaces 179 interface with the lead-in edges 350, 450. Having the lead-in surfaces 179 and the lead-in edges 350, 450 angled allows the module circuit board 176 to bypass the contact positioners 300, 400 without stubbing against the fronts of the contact positioners 300, 400 and forces the contact positioners 300, 400 to move outward toward the outward position.

As the module circuit board 176 is loaded into the card slot 216, the lip 340 at the front of the upper contact positioner 300 and the end wall 334 at the rear of the contact positioner 300 are lifted off of (raised) the upper support land 342 and the upper support tabs 233, respectively. As the upper contact positioner 300 is lifted upward, the contact positioner 300 moves the mating end 246 of the upper contact 240 upward with the contact positioner 300. For example, the edge 338 presses against the arm 254 to flex the mating end 246. The tip 252 is lifted upward as the arm 254 is flexed outward. The tip 252 is moved upward relative to the module circuit board 176 from the initial inward position (shown in FIG. 6), which prevents stubbing of the tip 252 on the card edge 178 when the module circuit board 176 is loaded into the card slot 216.

In an exemplary embodiment, the finger 256 protrudes inward of the inner end 316 such that the tip 252 is exposed beyond the inner end 316 for interfacing with the module circuit board 176. For example, as the module circuit board 176 is advanced into the card slot 216, the lead-in surface 179 at the card edge 178 eventually engages the tip 252 to further lift the mating end 246 outward relative to the contact positioner 300. In an exemplary embodiment, the finger 256 includes a lead-in surface 253 at the tip 252 to prevent interference or stubbing of the module circuit board 176 on the exposed portion of the finger 256 during loading of the module circuit board 176 into the card slot 216.

Similarly, as the module circuit board 176 is loaded into the card slot 216, the lip 440 at the front of the contact positioner 400 and the end wall 434 at the rear of the lower contact positioner 400 are lifted off of (lowered) the lower support land 442 and the lower support tabs 233, respectively. As the lower contact positioner 400 is lifted downward, the contact positioner 400 moves the mating end 266 of the lower contact 260 downward with the contact positioner 400. For example, the edge 438 presses against the arm 274 to flex the mating end 266. The tip 272 is moved downward as the arm 274 is flexed outward. The tip 272 is moved downward relative to the module circuit board 176 from the initial inward position (shown in FIG. 6), which prevents stubbing of the tip 272 on the card edge 178 when the module circuit board 176 is loaded into the card slot 216.

In an exemplary embodiment, the finger 276 protrudes inward of the inner end 416 such that the tip 272 is exposed beyond the inner end 416 for interfacing with the module circuit board 176. For example, as the module circuit board 176 is advanced into the card slot 216, the lead-in surface 179 at the card edge 178 eventually engages the tip 272 to further lift the mating end 266 outward relative to the contact positioner 400. In an exemplary embodiment, the finger 276 includes a lead-in surface 273 at the tip 272 to prevent interference or stubbing of the module circuit board 176 on the exposed portion of the finger 276 during loading of the module circuit board 176 into the card slot 216.

Figure 8:
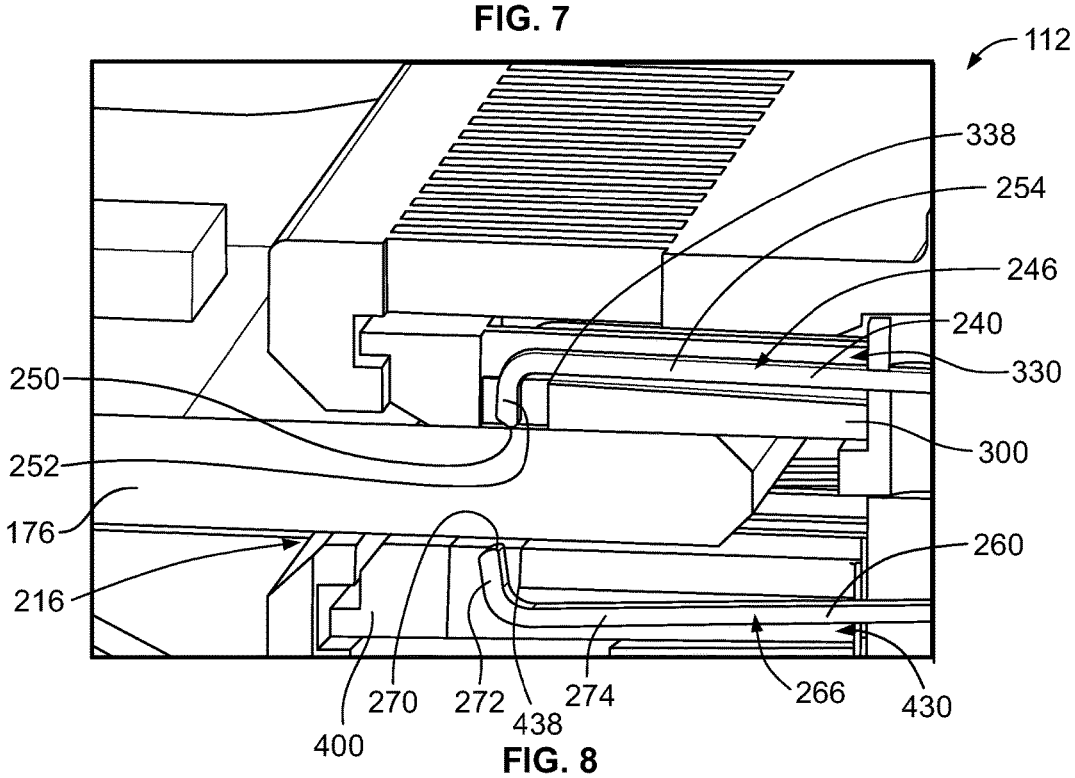
FIG. 8 is a partial sectional view of a portion of the card edge connector in accordance with an exemplary embodiment.

FIG. 8 is a partial sectional view of a portion of the card edge connector 112 showing the module circuit board 176 loaded into the card slot 216. In the mated position, the upper and lower contacts 240, 260 are electrically connected to contact pads on the upper and lower surfaces of the module circuit board 176. The tips 252, 272 directly engage the contact pads on the module circuit board 176. No portions of the contacts 240, 260 extend beyond the mating interfaces 250, 270 at the tips 252, 272 to create an electrical stub.

When the module circuit board 176 is loaded into the card slot 216, the module circuit board 176 lifts the mating ends 246, 266 outward off of the contact positioners 300, 400. The mating ends 246, 266 are free of the contact positioners 300, 400. The arms 254, 274 are moved outward in the contact channels 330, 430 such that the arms 254, 274 no longer engage the edges 338, 438. When the mating ends 246, 266 are flexed outward, the deflection creates an internal spring load causing the mating ends 246, 266 to be spring biased inward against the module circuit board 176. The tips 252, 272 are driven inward into electrical engagement with the contact pads on the module circuit board 176 to ensure a reliable electrical connection with the module circuit board 176.

Figure 9:
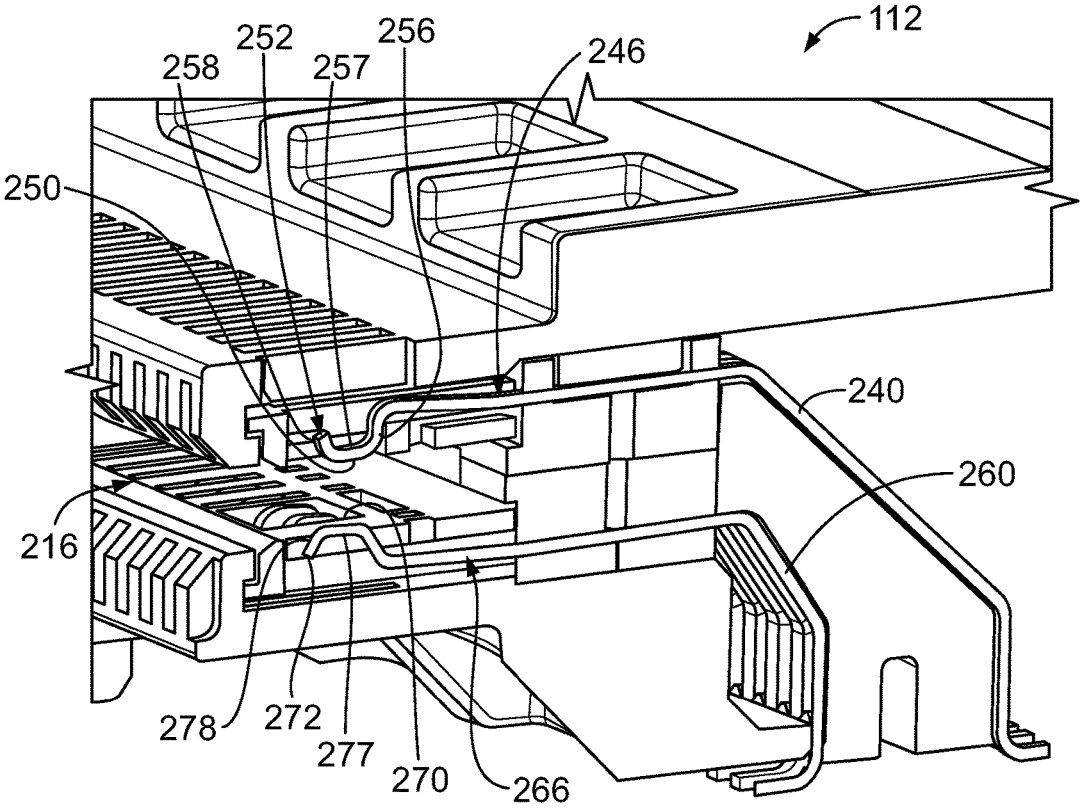
FIG. 9 is a partial sectional view of the card edge connector in accordance with an exemplary embodiment.
Figure 10:
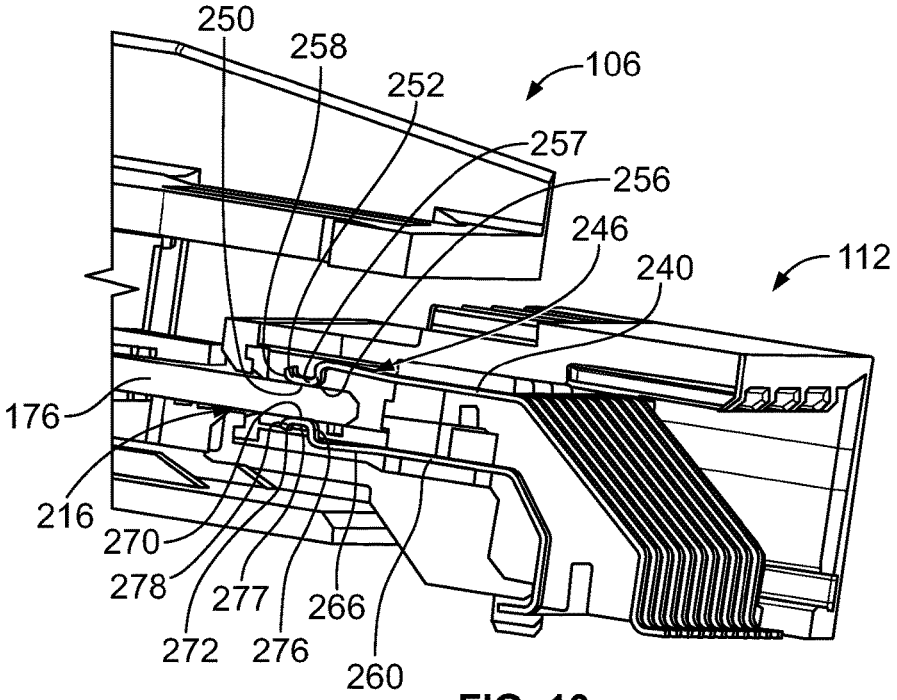
FIG. 10 is a partial sectional view of the card edge connector in accordance with an exemplary embodiment.

FIG. 9 is a partial sectional view of the card edge connector 112 in accordance with an exemplary embodiment showing the mating ends 246, 266 of the upper and lower contacts 240, 260 having an alternative mating interface 250, 270. FIG. 10 is a partial sectional view of the card edge connector 112 in accordance with an exemplary embodiment showing the pluggable module 106 mated with the card edge connector 112. In the illustrated embodiment, the fingers 256, 276 are shaped differently than the embodiment illustrated in FIG. 8.

The fingers 256, 276 in the illustrated embodiment have elongated segments 257, 277 upstream of the tips 252, 272 of the mating ends 246, 266. The elongated segments 257, 277 define the mating interfaces 250, 270 for mating with the contact pads of the module circuit board 176. The elongated segments 257, 277 make a reliable electrical connection with the contact pads of the module circuit board 176 for a longer length of the contact pads than the embodiment illustrated in FIG. 8. The fingers 256, 276 include flared ends 258, 278 between the elongated segments 257, 277 and the tips 252, 272. The flared ends 258, 278 provide a lead-in for mating with the module circuit board 176 to prevent mechanical stubbing during loading of the module circuit board 176 into the card slot 216.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A card edge connector for mating with a pluggable module comprising:

a housing having a cavity, a card slot at a front of the housing and a chamber adjacent the card slot, the card slot configured to receive a card edge of a module circuit board of the pluggable module;

a contact assembly received in the cavity, the contact assembly having a contact holder, the contact assembly having first contacts arranged in a first contact array held by the contact holder, the first contacts having mating ends extending from the contact holder into the card slot for mating with the module circuit board, the contact assembly having a contact positioner forward of the contact holder located in the chamber, the contact positioner receiving the mating ends of the first contacts, the contact positioner being movable in the chamber relative to the contact holder and the housing between an inward position and an outward position, the contact positioner moving the mating ends of the first contacts outward from the card slot as the contact positioner is moved from the inward position to the outward position.

2. The card edge connector of claim 1, wherein the contact positioner includes an inner end, the mating ends of the first contacts extending inward of the inner end to engage the module circuit board for electrical connection with the module circuit board.

3. The card edge connector of claim 1, wherein the contact positioner includes a lead-in edge configured to engage the pluggable module when the pluggable module is loaded into the card slot, the contact positioner being movable between the inward position and the outward position by engagement of the lead-in edge with the pluggable module.

4. The card edge connector of claim 1, wherein the contact positioner includes an inner end facing the card slot, the contact positioner located with the inner end in the card slot in the inward position, the contact positioner being moved outward such that the inner end is located out of the card slot in the outward position.

5. The card edge connector of claim 1, wherein the housing includes a support land in the chamber, the contact holder including a support tab at a front of the contact holder, the contact positioner resting on the support land and the support tab in the inward position, the contact positioner being lifted off of the support land and the support tab in the outward position.

6. The card edge connector of claim 1, wherein the mating ends of the first contacts are arranged in pre-loaded positions when the contact positioner is in the inward position, the mating ends of the first contacts being moved outward by the contact positioner to lifted positions when the contact positioner is in the outward position, the mating ends of the first contacts being moved outward relative to the contact positioner by the pluggable module to released positions when the pluggable module is loaded into the card slot.

7. The card edge connector of claim 6, wherein the mating ends of the first contacts include tips extending inward of an inner end of the contact positioner in the lifted positions, the tips being generally coplanar with the inner end in the released positions.

8. The card edge connector of claim 6, wherein the mating ends of the first contacts engage the contact positioner in the lifted positions, the mating ends of the first contacts being free of and released from the contact positioner in the released positions.

9. The card edge connector of claim 1, wherein each mating end includes an arm and a finger extending from the arm to a tip, the tip having a mating interface configured to engage the module circuit board.

10. The card edge connector of claim 1, wherein the contact positioner includes contact channels receiving mating ends of corresponding first contacts, the contact positioner includes contact slots at an inner end of the contact positioner open to corresponding contact channels, the mating ends of the first contacts having tips received in corresponding contact slots, the tips being exposed inward of the inner end through the contact slots.

11. The card edge connector of claim 10, wherein the contact positioner includes edges between the contact channels and the contact slots, the mating ends of the first contacts engaging the corresponding edges and biasing the contact positioner inward at the edges towards the inward position, the mating ends of the first contacts being lifted off of the edges by the module circuit board when mated to the module circuit board.

12. A card edge connector for mating with a pluggable module comprising:

a housing extending between a front and a rear, the housing having a cavity between the front and the rear, the housing having a card slot at the front configured to receive a card edge of a module circuit board of the pluggable module, the housing having a top wall above the card slot including an upper chamber and a bottom wall below the card slot including a lower chamber;

a contact assembly received in the cavity, the contact assembly having a contact holder, the contact assembly having upper contacts arranged in an upper contact array held by the contact holder and lower contacts arranged in a lower contact array held by the contact holder, the contact assembly having an upper contact positioner associated with the upper contacts and a lower contact positioner associated with the lower contacts;

the upper contacts having mating ends extending from the contact holder into the card slot for mating with the module circuit board and the lower contacts having mating ends extending from the contact holder into the card slot for mating with the module circuit board;

the upper contact positioner located in the upper chamber forward of the contact holder receiving the mating ends of the upper contacts and the lower contact positioner located in the lower chamber forward of the contact holder receiving the mating ends of the lower contacts, the upper contact positioner and the lower contact positioners being located on opposite sides of the card slot, wherein the upper contact positioner and the lower contact positioner are movable in the housing relative to the contact holder generally toward each other and away from each other between inward positions and an outward positions, the upper contact positioner moving the mating ends of the upper contacts outward from the card slot as the contact positioner is moved from the inward position to the outward position, the lower contact positioner moving the mating ends of the lower contacts outward from the card slot as the contact positioner is moved from the inward position to the outward position.

13. The card edge connector of claim 12, wherein the upper contact positioner includes an inner end and the lower contact positioner includes an inner end, the mating ends of the upper contacts and the lower contacts extending inward of the corresponding inner ends to engage opposite sides of the module circuit board for electrical connection with the module circuit board.

14. The card edge connector of claim 12, wherein the upper contact positioner and the lower contact positioner includes lead-in edges configured to engage the pluggable module when the pluggable module is loaded into the card slot, the upper contact positioner and the lower contact positioner being movable between the inward positions and the outward positions by engagement of the lead-in edges with the pluggable module.

15. The card edge connector of claim 12, wherein the upper contact positioner and the lower contact positioner include inner ends facing each other across the card slot, the inner ends being located in the card slot in the inward positions, the inner ends being located out of the card slot in the outward positions.

16. The card edge connector of claim 12, wherein the housing includes a support land in the upper chamber, the contact holder including a support tab at a front of the contact holder, the upper contact positioner resting on the support land and the support tab in the inward position, the upper contact positioner being lifted off of the support land and the support tab in the outward position.

17. The card edge connector of claim 12, wherein the mating ends of the upper contacts are arranged in pre-loaded positions when the upper contact positioner is in the inward position, the mating ends of the upper contacts being moved outward by the upper contact positioner to lifted positions when the upper contact positioner is in the outward position, the mating ends of the upper contacts being moved outward relative to the upper contact positioner by the pluggable module to released positions when the pluggable module is loaded into the card slot, the mating ends of the upper contacts including tips extending inward of an inner end of the upper contact positioner in the lifted positions, the tips being generally coplanar with the inner end in the released positions.

18. The card edge connector of claim 12, wherein each mating end includes an arm and a finger extending from the arm to a tip, the tip having a mating interface configured to engage the module circuit board.

19. The card edge connector of claim 12, wherein the upper contact positioner includes contact channels receiving mating ends of corresponding upper contacts, the upper contact positioner includes contact slots at an inner end of the upper contact positioner open to corresponding contact channels, the upper contact positioner includes edges between the contact channels and the contact slots, the mating ends of the upper contacts having tips received in corresponding contact slots, the tips being exposed inward of the inner end through the contact slots, the mating ends of the upper contacts engaging the corresponding edges and biasing the contact positioner inward at the edges towards the inward position, the mating ends of the upper contacts being lifted off of the edges by the module circuit board when mated to the module circuit board.

20. A receptacle connector assembly comprising:

a receptacle cage having walls defining a module channel configured to receive a pluggable module, the walls providing electrical shielding for the module channel; and a card edge connector within the module channel for mating with the pluggable module, the card edge connector including a housing and a contact assembly held by the housing, the housing having a cavity and a card slot at a front of the housing configured to receive a card edge of a module circuit board of the pluggable module, the cavity having a chamber adjacent the card slot, the contact assembly having a contact holder, the contact assembly having first contacts arranged in a first contact array held by the contact holder, the first contacts having mating ends extending from the contact holder into the card slot for mating with the module circuit board, the contact assembly having a contact positioner forward of the contact holder located in the chamber, the contact positioner receiving the mating ends of the first contacts, the contact positioner being movable in the chamber relative to the contact holder and the housing between an inward position and an outward position, the contact positioner moving the mating ends of the first contacts outward from the card slot as the contact positioner is moved from the inward position to the outward position.

* * * * *